US007036247B1

(12) United States Patent
Frazee et al.

(10) Patent No.: US 7,036,247 B1
(45) Date of Patent: May 2, 2006

(54) ADAPTABLE FRONT END BUCKET

(76) Inventors: Edward Frazee, 23783 Caves Rd., Gambier, OH (US) 43022; Nora Frazee, 23783 Caves Rd., Gambier, OH (US) 43022

( * ) Notice: Subject to any disclaimer, the term of this patent is extended or adjusted under 35 U.S.C. 154(b) by 0 days.

(21) Appl. No.: 10/809,610

(22) Filed: Mar. 25, 2004

(51) Int. Cl.
*E02F 3/00* (2006.01)

(52) U.S. Cl. ..... 37/270; 37/407; 172/815; 172/817

(58) Field of Classification Search ..... 37/270, 37/271, 266, 383, 381, 407–4; 172/815, 172/817, 834, 811; 414/726

See application file for complete search history.

(56) References Cited

U.S. PATENT DOCUMENTS

| | | | | |
|---|---|---|---|---|
| 2,657,281 | A | 11/1953 | Larsen | |
| 2,691,228 | A | 10/1954 | Smith | |
| 3,559,314 | A | 2/1971 | Funk | |
| 4,890,400 | A | 1/1990 | Long | |
| 4,903,418 | A | 2/1990 | Loudon | |
| 5,901,479 | A | 5/1999 | Langdon | |
| D425,527 | S | 5/2000 | Deyo | |
| 6,336,281 | B1 * | 1/2002 | Fulton, III | 37/197 |
| 2003/0005605 | A1 | 1/2003 | Kaczmarski | |

* cited by examiner

*Primary Examiner*—Christopher J. Novosad
(74) *Attorney, Agent, or Firm*—Lawrence J. Gibney, Jr.

(57) ABSTRACT

This device can be attached to the standard tractor blade and converts the tractor blade into a scoop or bucket. This device will increase the utility of a standard tractor by increasing its functions. It will be lightweight and durable and can be easily placed on the tractor blade and easily removed.

12 Claims, 3 Drawing Sheets

ADAPTABLE FRONT END BUCKET

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

1. Field of the Invention

This is a way to improve a tractor blade by converting it into a bucket as well as a blade using this device.

2. Prior Art

Tractors are typically used to push debris and other items. They do not, however, serve as buckets to lift and eventually move material. The present device is an attachment to convert a tractor blade into a bucket temporarily.

The prior art in this area involves bucket attachments for tractor blades, which involve mechanical levers and other similar devices. The prior art generally describe devices, which are permanently attached to the tractor blade.

Representative examples of this prior art include Long, U.S. Pat. No. 4,890,400, Funk, U.S. Pat. No. 3,559,314, and Deyo patent number D425,527.

One of the disadvantages of the prior art is that the items must be permanently attached to the tractor blade. The current device is lightweight and portable enough to be easily attached and reattached at will. Additionally, no major alterations need to be made to the tractor blade as this device is not meant to be a permanent attachment.

BRIEF SUMMARY OF THE INVENTION

This is a device, which has a flat base member, two side panels and a means to secure the device to a tractor. Pieces of angle rod are welded or attached to the side panels to provide stability.

The base member is a flat, solid piece of metal. The base member will be positioned generally perpendicular to the lower edge of the blade of the tractor. When the device is installed, the base member and the tractor blade form a scoop.

One end of a side panel is welded or connected to the base member and the other end of the side panel is welded or connected to a top servicing rod.

The side panels extend in a vertical direction from the base member. The side panels are parallel to each other and extend the height of the tractor blade. A top securing rod is inserted over the top surface of the tractor blade and serves to secure its position along the top edge of the tractor blade. Most tractor blades are made such that the top edge forms a lip against which the top securing rod would fit. If the top edge does not have a lip one can be installed to accommodate the top securing rod of the device.

On the bottom of the base member holes are placed at the bottom of the side panels to accommodate a bottom securing rod, which extends slightly more than the length of the tractor blade. Cotter pins on both ends of the bottom securing rod would secure the bottom securing rod in place.

In another embodiment the device is secured with pins, which maintain the position of the device on the bottom.

Pieces of angle iron, which are on the inside surface of the side panels keep the device in position while the device is in use and prevent the device from tilting.

The device is designed to be portable and readily removed from the tractor blade. It is contemplated that a variety of metals may be used to construct the device. However, steel is probably preferred for durability reasons.

DETAILED DESCRIPTION OF THE EMBODIMENTS

Figure 1:
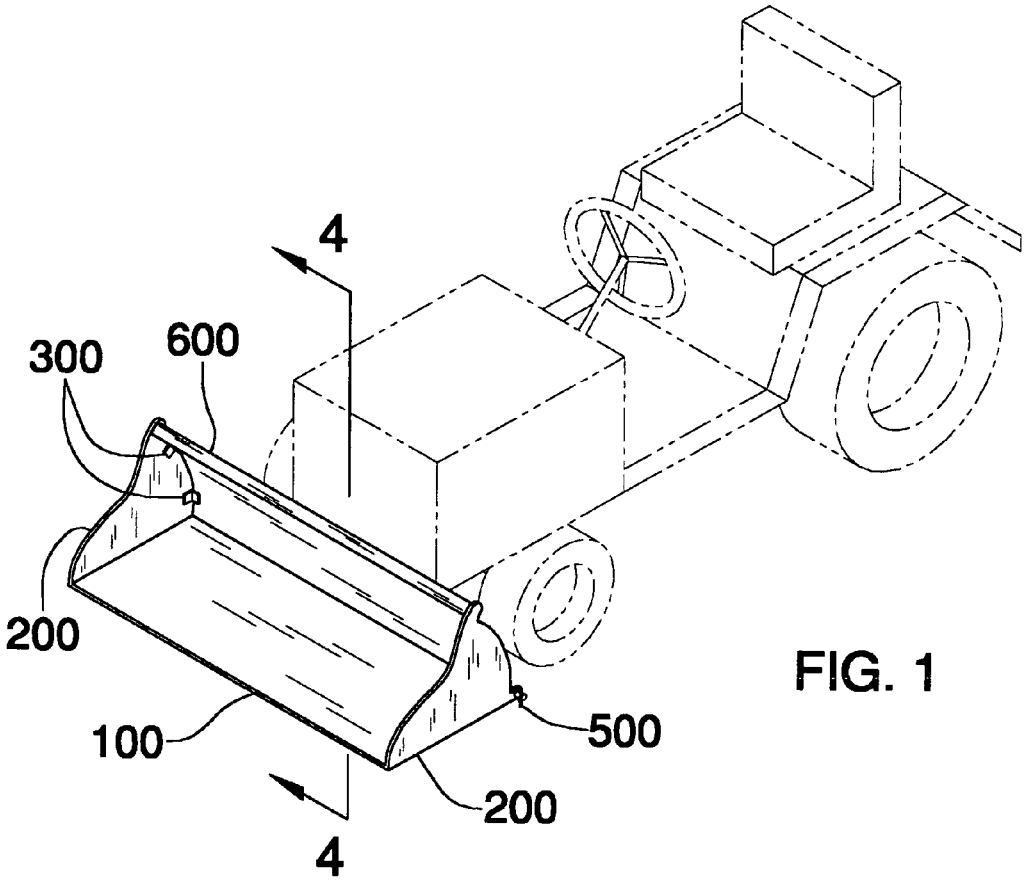
FIG. 1 is a perspective view of the device attached to the front of a tractor blade and the outline of a tractor.
Figure 2:
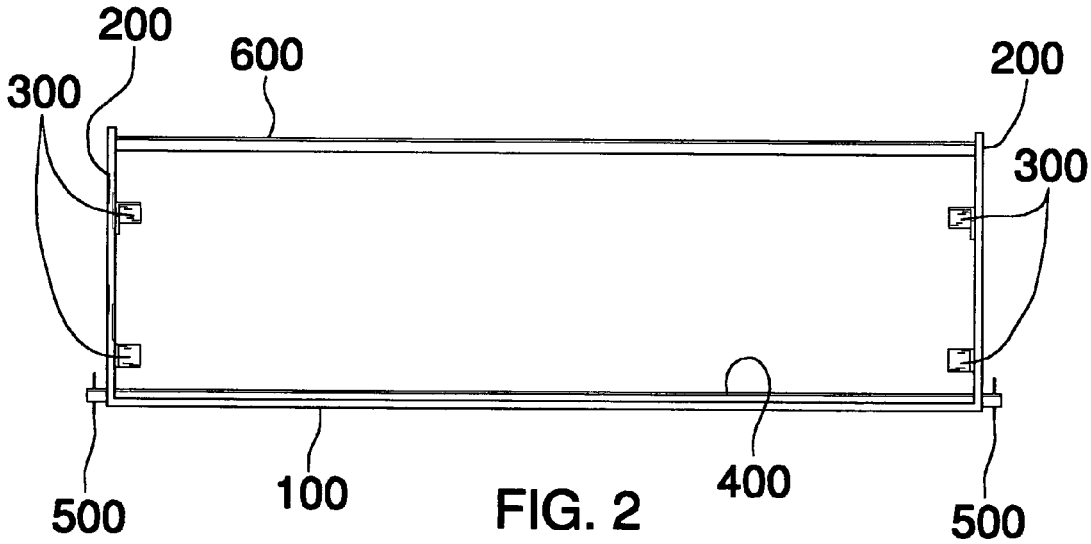
FIG. 2 is a front view of the device with the tractor not shown.
Figure 3:
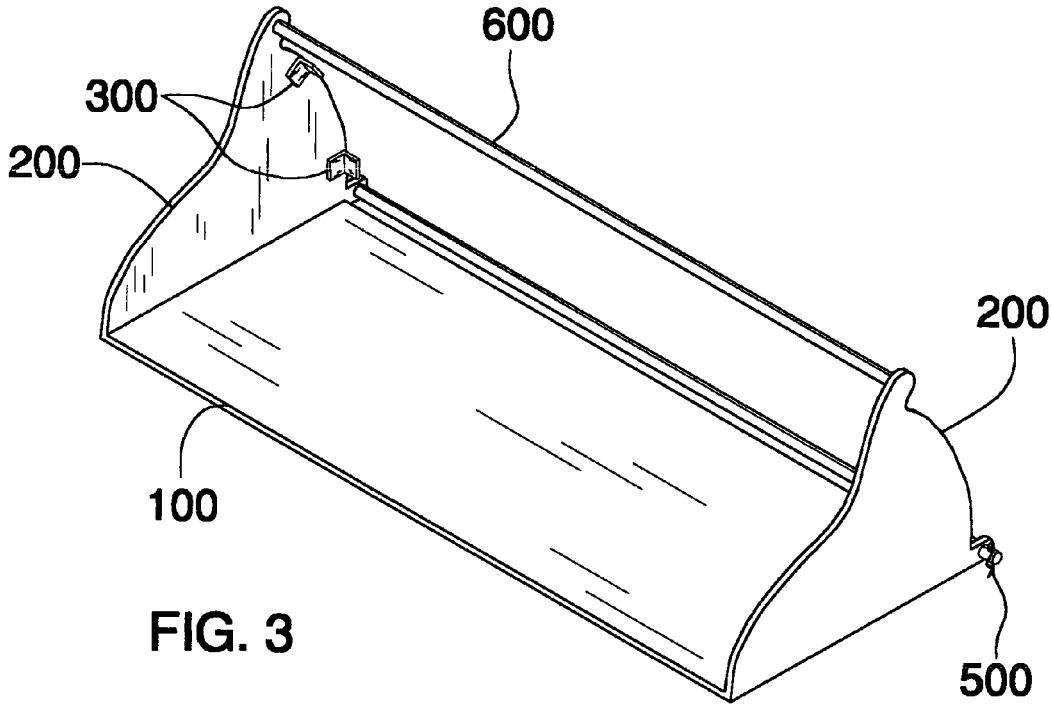
FIG. 3 is a perspective view of the device with the tractor not shown.

According to FIG. 3 this device consists of a base member 100, two end plates 200, a top securing rod 600 and a means to attach this particular device to a tractor blade 720. FIGS. 1, 2 The tractor itself and the tractor blade 720 are not claimed as part of this device.

Angle clips or brackets 300 are attached to the inside surface of the respective end plates 200 and lie flush with the edge of the respective end plate 200. The angle clips 300 allow this device to be secured in place and rest firmly against one side of the tractor blade 720 while the device is in use. The angle clips 300 are not attached to the tractor blade 720 when the device is installed but are merely used to maintain the position of the device relative to the tractor blade 720 to prevent titling or swaying of the device while in operation. FIGS. 1, 3.

Figure 4:
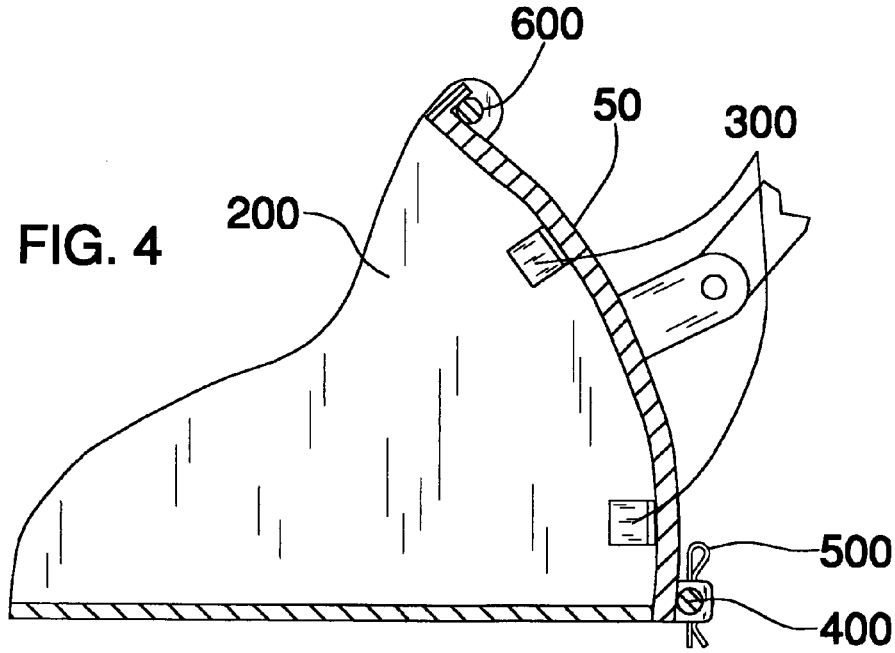
FIG. 4 is a cross section of the device as indicated by the 4–4 section on FIG. 1.

On the bottom of this device is a bottom removal securing rod 400, which is secured with a cotter pin 500 on both sides of the device. FIGS. 2, 4. The bottom removal securing rod 400 is placed on the back surface 725 of the tractor blade 720 and secures the device in place. FIG. 4 The bottom securing rod 400 extends slightly beyond the length of the device and holes are positioned at the ends of the rod to install a cotter pin 500 at each end. FIGS. 1, 2.

A top bar 600 slips over the top of the tractor blade 720 and hooks on the top edge or lip 705 of the tractor blade. FIG. 4.

The end plates 200, which are welded to the outside edges of the base member 100, form the "bucket" or "scoop" of this particular device when the device is installed. The end plates 200 extend vertically to slightly higher than the tractor blade 720. When the device is installed, the length between the end plates 200 is slightly longer than the tractor blade 720 to complete the "bucket".

Figure 5:
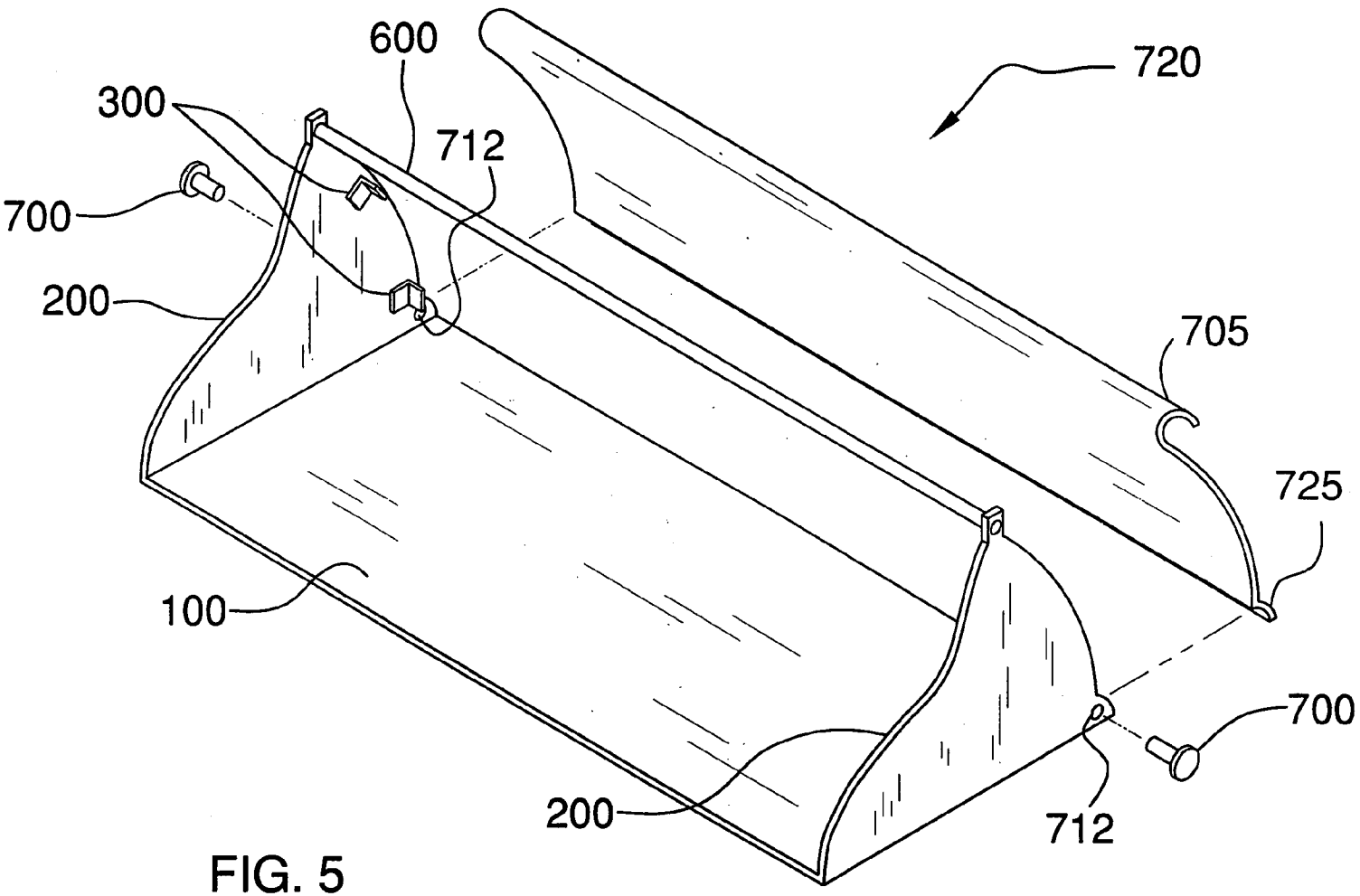
FIG. 5 is a perspective view of the device using pins to secure the device.

A top rod 600 is used to connect the end plates 200 at the top. The top rod 600 is inserted in the lip 705 of the tractor blade when the device is installed. FIGS. 4, 5 The standard tractor blade 720 is equipped with a lip 705, which allows the top rod 600 to be held securely in place during normal operation. The top rod 600 is welded to the interior surface of the end plates 200. FIG. 5.

FIG. 1 depicts how the device will be mounted on a tractor blade 720 with a sketch of a tractor on this drawing.

FIG. 2 depicts the various parts of the device as seen from the front. According to FIG. 2 the tractor blade 720 would occupy the space between the top bar 600 and the bottom securing rod 400.

The outside edges of the tractor blade (not shown) would rest against the angle clips 300 and be secured by the top rod 600 and the removable securing rod 400 and cotter pins 500. FIGS. 2, 4 Two sets of angle clips are contemplated per end plate as shown in FIGS. 2 and 3 to provide the required stability.

Because the device is meant to be portable and easily removed, the device will be made of lightweight yet durable material.

It is contemplated that because of the environments, which will be encountered, that the device will be constructed from metals and preferably steel or aluminum.

SECOND EMBODIMENT

The device may also be secured at the bottom by pins 700 instead of a removable securing rod 400 and cotter pins 500. FIG. 5 Other means of attachment, which do not involve a bottom securing rod could also include nuts and bolts.

In this embodiment the top lip 705 of the tractor blade 720 is placed over the bar 600 of the device. The bottom surface 100 and edges 200 are identical in this embodiment. Pins 700 are inserted through holes 712, which have been provided so that the pin 700 will be positioned on the back surface 725 of the tractor blade 720. FIG. 5 In the second embodiment the pins 700 take the place of the removable securing rod 400 in the prior embodiment.

In the second embodiment the device operates in the same manner but the means to secure the device at the bottom edge is different.

The invention claimed is:

1. A device to be attached to the front of a tractor blade which comprises:

a. a base member;

b. a top rod;

c. end plates;

d. angle clips;

e. removable securing rod;

f. cotter pins;

g. means of attachment;

said end plates are connected to the outside edge of a flat base member and extend vertically from the point of attachment;

said end plates are the approximate height of the tractor blade;

said top rod secures the topmost point of the end plates to the tractor blade;

said top rod is inserted into the lip which is provided on the top surface of the tractor blade;

said means of attachment allows the device to be secured in place by resting the top rod within the lip of the tractor blade and the removable securing rod against the back surface of the tractor blade;

wherein the angle clips are attached to the interior of the side of the end plates.

2. The angle clips as described in claim 1, wherein there are two angle clips per end plate.

3. The top rod as described in claim 1, wherein it is attached to the top surface of the end plates.

4. The end plates as described in claim 1, wherein they are perpendicular to the bottom plate on both sides.

5. The means of attachment, as described in claim 1, wherein cotter pins are used.

6. The angle clips as described in claim 1, wherein they are attached to the interior of the side of the end plates.

7. The angle clips as described in claim 1, wherein there are two angle clips per end plate.

8. The top rod as described in claim 1, wherein the top rod is attached to the top surface of the end plates.

9. The end plates as described in claim 1, wherein they are perpendicular to the bottom plate on both sides.

10. A device to be attached to the front of a tractor blade which is comprised of:

a. a base member;

b. a top rod;

c. end plates;

d. angle clips;

e. pins;

f. a means of attachment;

said end plates are connected to the outside edge of a flat base member and extend vertically from the point of attachment;

said end plates are the approximate height of a tractor blade;

said top rod secures the topmost point of the end plates to the tractor blade;

said top rod is inserted into the lip which is provided on the top surface of the tractor blade;

wherein the angle clips are attached to the interior of the side of the end plates;

said means of attachment allows the device to be secured in place by resting the top rod within the lip of the tractor blade and the means of attachment against the back surface of the tractor blade.

11. The angle clips as described in claim 10, wherein they are welded to the interior surface of the respective end plates.

12. The means of attachment, as described in claim 10, wherein pins are used.

* * * * *